United States Patent [19]

Misono et al.

[11] 4,374,344

[45] Feb. 15, 1983

[54] COLOR PICTURE TUBE WITH ELECTRICALLY CONDUCTIVE FRIT FILM ON ENVELOPE SURFACE

[75] Inventors: Masayoshi Misono, Chiba; Shigeki Kitamura, Mobara, both of Japan

[73] Assignee: Hitachi, Ltd., Tokyo, Japan

[21] Appl. No.: 179,476

[22] Filed: Aug. 18, 1980

[30] Foreign Application Priority Data

Aug. 22, 1979 [JP] Japan ..... 54-106087

[51] Int. Cl.[3] ..... H01J 29/88

[52] U.S. Cl. ..... 313/479; 313/482

[58] Field of Search ..... 313/479, 482, 451, 456, 313/417

[56] References Cited

U.S. PATENT DOCUMENTS

| | | | |
|---|---|---|---|
| 2,877,370 | 3/1959 | Hanson | 313/456 |
| 3,792,300 | 2/1974 | Benda et al. | 313/479 X |
| 4,119,885 | 10/1978 | Stöver | 313/479 |

FOREIGN PATENT DOCUMENTS

| | | | |
|---|---|---|---|
| 2712711 | 9/1978 | Fed. Rep. of Germany | 313/479 |
| 53-69578 | 6/1978 | Japan | 313/477 HC |

*Primary Examiner*—Palmer C. Demeo

*Attorney, Agent, or Firm*—Charles E. Pfund

[57] ABSTRACT

A conductive spacer having one end secured to an electron gun structure housed in the neck tube of a color picture tube makes contact, at the other end, to a conductive film coated on the inner wall surface of the envelope of the color picture tube. A portion of the conductive film making contact with the conductive spacer comprises a conductive frit glass film.

9 Claims, 6 Drawing Figures

COLOR PICTURE TUBE WITH ELECTRICALLY CONDUCTIVE FRIT FILM ON ENVELOPE SURFACE

BACKGROUND OF THE INVENTION

The present invention concerns a color picture tube, and more particularly it concerns the structure of a conductive film coated on the inner wall surface of the neck tube.

Generally, the vacuum envelope for the color picture tube is made of glass and in order to supply high voltage applied to the anode button to the anode of an electron gun structure housed within the vacuum envelope, a conductive film is formed on the inner wall surface of the vacuum envelope and a conductive spacer made of metal which is attached to the tip of the electron gun structure makes contact with the conductive film. The material for this conductive film is subject to very severe restrictions such as it should be resistant to high temperatures and high vacuum, be resistant to scratch, and have a good conductivity, a small gas discharge, and excellent adhesion. In addition, excellent workability at the time of coating and inexpensiveness are required for the material. Accordingly, there are limitations on the conductive materials which may be used for this purpose, and at present the mixture of a conductive material such as graphite and water glass is mainly used in the industry.

FIG. 1 is a partial sectional view of one example of a conventional color picture tube. In this figure, a vacuum envelope 1 made of glass comprises a panel portion 1*a*, a funnel portion 1*b*, and a neck tube 1*c*. A shadow mask 2 is positioned opposite to a fluorescent screen 3 coated on the inner surface of the panel portion 1*a*. A coating of a conductive film 4 covers the inner wall surface of the funnel portion 1*b* and the neck tube 1*c* of the vacuum envelope 1. An anode button 5 is provided for connecting external high voltage to the conductive film 4. A conductive spacer 7 has one end secured to the tip of an electron gun structure 6 and the other end in contact with the conductive film 4, so that high voltage applied to the anode button 5 is fed to the anode of the electron gun structure 6 via the conductive spacer 7. When the high voltage applied to the anode button 5 from an external high voltage generating circuit (not shown) is relayed to the anode of the electron gun structure 6 via the conductive film 4 and the conductive spacer 7, the current normally flowing into the electron gun 6 is extremely small. However, in the step of knocking during the manufacture of the picture tubes and the step of operational test in the television set, sparks generate at the electron gun 6 at which time a momentary maximum current of about 1000 A having a wave form as shown in FIG. 2 passes through the conductive film 4 and the conductive spacer 7. Since the resistance across the conductive film 4 and the conductive spacer 7 is several tens of ohms, energy consumed in the path across the conductive film 4 and the conductive spacer 7 at the time of the spark generation reaches about $10^7$ Joules momentarily, and the heat thus generated causes the contact point portion of the conductive film 4 to the conductive spacer 7 to spatter. When the color picture tube is operated in the television set, the potential difference between the electrodes constituting the main lens of the electron gun 6 exceeds about 20 kV. The distance between the electrodes is, however, only about 1 mm, so that even a very small amount of conductive dusts present in the tube and deposited on the electrodes generates spark which leads to spattering of the contact point portion of the conductive film 4 to the conductive spacer 7, thus greatly undermining the reliability of the picture tubes.

When the electron gun 6 is inserted into the neck tube 1*c* at the time the picture tube is being assembled, the conductive spacer 7 inevitably rubs a portion of the conductive film 4. On the other hand, the conventional conductive film 4 uses powdered graphite as the main conductive material and water glass as a binder. Such a conductive film 4 is soft and easily scratched off when rubbed on the surface. Not only is it extremely difficult to completely eliminate this scratching, but also it is unavoidable that the scratched dirts remain in the tube and cause spark discussed above.

SUMMARY OF THE INVENTION

An object of the present invention is to provide a color picture tube which can minimize internal spark and Joule heat.

Another object of the present invention is to provide a color picture tube with a conductive film having a portion of mechanical rigidity and low resistivity in contact with a conductive spacer.

According to the present invention, in a color picture tube comprising a vacuum envelope constituted by a panel portion, a funnel portion and a neck tube, an electron gun structure housed in the neck tube, a conductive film coated on the inner wall surface of the envelope and extending from the funnel portion to the neck tube, and a conductive spacer having one end secured to the electron gun structure and the other end in contact with the conductive film, a portion of the conductive film which makes contact with the conductive spacer comprises a conductive frit film made of a mixture of a conductive material and frit glass.

DESCRIPTION OF PREFERRED EMBODIMENTS

In order to facilitate understanding of the present invention, the conductive film will first be explained.

The reasons why the conductive film is coated on the inner wall surface of the color picture tube envelope are:

(1) To obtain a uniform potential throughout the inner wall surface of the envelope.

(2) To supply the anode voltage to the electron gun from the high voltage source.

(3) To form a capacitor along with an additional conductive film coated on the outer surface of the envelope, which capacitor acts as a ripple filter for the high voltage circuit.

(4) To physically absorb the inert gas remaining within the envelope.

As a material to meet item (4) above, only graphite is available at present. Therefore, other materials than graphite may be used for the conductive film provided that the function in the above item (4) is not disturbed. Accordingly, in the present invention, a conductive frit glass film is applied for only a portion of the conductive film on the inner wall surface of the neck tube which makes contact with the conductive spacer.

The conductive frit glass is a mixture of frit glass and a conductive material in the form of powder. On the other hand, since the vacuum envelope for the color picture tube is made of lead glass, the maximum temperature to be employed for sintering the conductive frit glass is about 450° C., thereby imposing limitations on the type of conductive materials to be mixed with the frit glass. A material to be best used for such a sintering temperature is powdered silver or mainly contains powdered silver. As the frit glass is also in the powdered form, when coating, the conductive frit glass is mixed with an organic binder having a suitable viscosity and adhesiveness to achieve a paste form. The binder for this purpose is a substance of nitrocellulose type, which is usually diluted in an organic solvent.

When the frit glass was actually applied, the following facts were revealed. That is, when the mixture of graphite and water glass was applied over the surface coated with the conductive frit glass, the graphite film was repulsed by the conductive frit glass film and a good conductive film was not prepared. This is because the binder of nitrocellulose type used for the frit is hydrophobic. Usual measure to cope with this problem is to apply the graphite film after sintering the frit glass.

However, a considerable increase in the cost in the manufacture of the color picture tubes is inevitable if a sintering furnace is specifically built for the above sintering. Because volume and heat capacity of the color picture tube are large and the envelope is made of glass so that such a sintering furnace becomes large-sized and complicated. Therefore, it is recommended that a graphite film may be applied in advance, and completely dried prior to forming the frit film.

Figure 1:
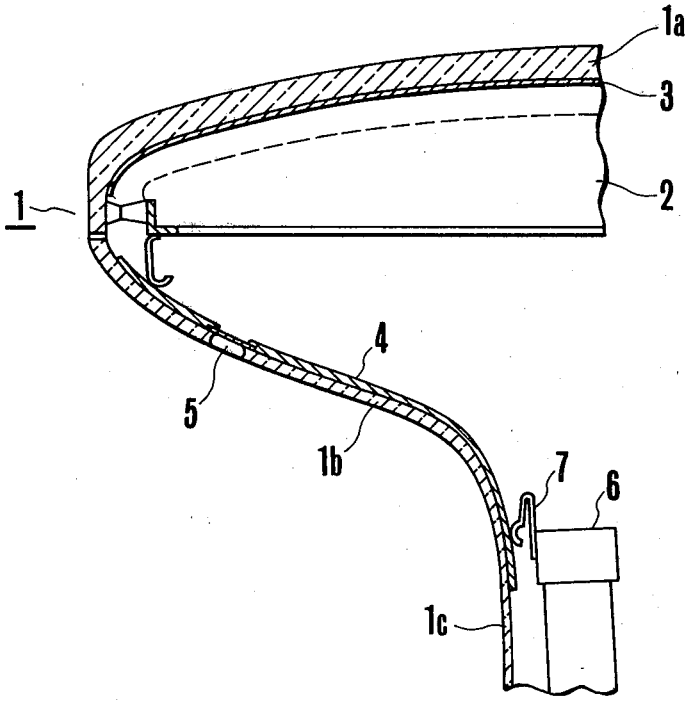
FIG. 1 is a partial sectional view of one example of a conventional color picture tube.
Figure 2:
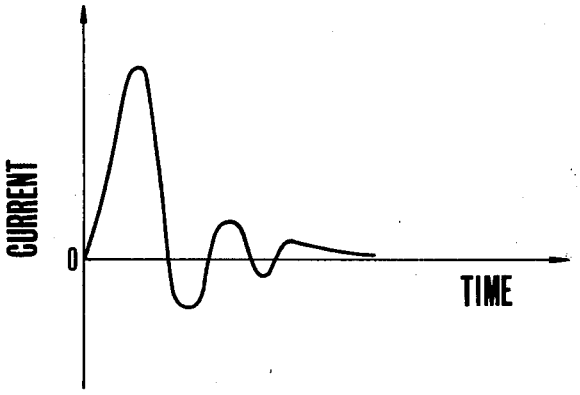
FIG. 2 shows the wave form of current passing at the time of spark generation.
Figure 3:
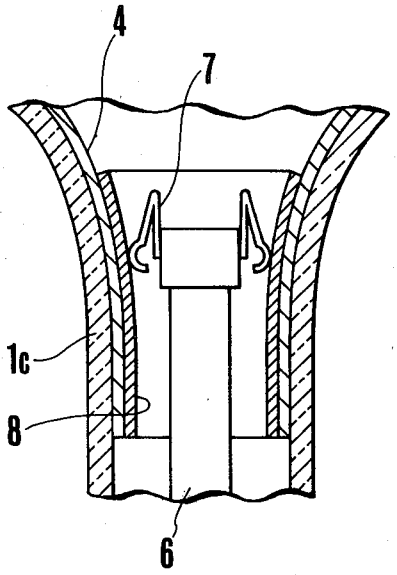
FIG. 3 is a partial sectional view of one embodiment of a color picture tube according to the present invention.

Reference is now made to FIG. 3 which shows a conductive film embodying the invention based on the above discussion and in which the corresponding parts to those in FIG. 1 are denoted by the identical numbers and the description thereof is eliminated. As shown, on a portion of a conductive film 4 formed on the inner wall surface of a neck tube 1*c* is applied and formed a conductive frit film 8 which is made of a mixture of frit glass and silver powder as a conductive material. Thus, the portion of the conductive film 4 making contact with a conductive spacer 7 has a double layer structure. In preparation of the conductive frit glass film 8, silver powder is mixed with the frit glass within the range of 5 to 98% by weight. This mixture is added with polyvinyl alcohol as a hydrophilic binder and coated on the conductive film 4 to form and conductive frit film 8. After sintering, the film 8 has a thickness of from 0.05 to 500 μm.

Sintering temperature for the conductive frit glass depends mainly on the kind of conductive material. The color picture tube is heat treated at a temperature of about 450° C. at the maximum and silver meeting this heat treatment temperature is used as the conductive material to be mixed with frit glass. A conductive frit glass film having a thickness of more than 500 μm is disadvantageous in that it tends to distort the neck tube or to peel off the underlying graphite film. Further, the conductive frit glass film 8 of this embodiment using silver as the conductive material has a small resistivity and a large mechanical rigidity, so that the contact resistance between the film 8 and the conductive spacer 7 is $10^{-2}$ to $10^{-3}$ ohms approximately, which is reduced by 1/1000 to 1/10,000 as compared with the conventional value of several tens of ohms and which can be considered substantially zero ohm for practical purposes.

Figure 4:
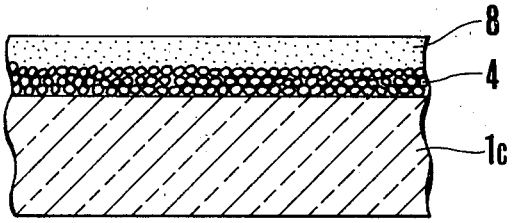
FIGS. 4 and 5 are partial sectional views showing adhesion of the conductive film in accordance with the present invention.
Figure 5:
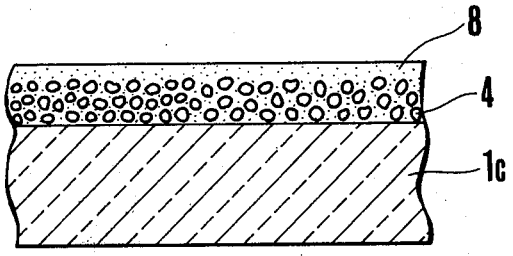

In the construction as mentioned above, the water glass used in the conventional art is hydroscopic and therefore it is sometimes difficult to coat the conductive frit on the surface of the conductive film 4 by trying to completely remove the moisture from the surface thereof. It is also impossible to increase the fluidity of the frit glass during sintering because of the restrictions imposed on the sintering temperatures. Thus, the affinity between the conductive frit film 8 and the conductive film 4 comprising graphite and water glass is not quite satisfactory as shown in FIG. 4. Therefore the present invention uses a hydrophilic binder such as higher alcohol, e.g. polyvinyl alcohol, for the conductive frit glass in order to facilitate permeation of the conductive frit film 8 into the conductive film 4 comprising a mixture of graphite and water glass, thereby obtaining an integral film from the two kinds of films, which has excellent electric properties, which is sturdy mechanically, and yet shows good workability. Accordingly, scratching-off of the conductive frit film 8 caused by the contact of the conductive spacer 7 is completely eliminated, no dusts are present, and therefore no spark generates.

Figure 6:
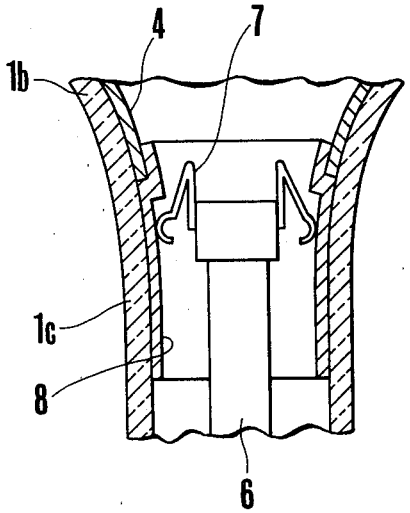
FIG. 6 is a partial sectional view of another embodiment of a color picture tube according to the present invention.

Turning now to FIG. 6, there is shown another embodiment of the present invention. In FIG. 6, the same numbers as those in FIG. 1 denote the same elements and the description thereof is eliminated. In this embodiment, a portion of the conductive film making contact with the conductive spacer comprises a single layer structure of conductive frit glass film which is directly coated on the inner wall surface of the vacuum envelope. More particularly, on the inner wall surface of a neck tube 1*c* where a conductive spacer 7 opposes is formed a conductive frit film 8 of a thickness within the range of 0.05 to 500 μm prepared by mixing a conductive material such as silver, a hydrophilic binder such as polyvinyl alcohol and frit glass. One end portion of the conductive frit film 8 overlaps the end of the conductive film 4 extending over the neck tube 1*c* and is adhered thereto in the same structure as mentioned in the first embodiment. In this second embodiment, silver as conductive material is contained by weight within the range of 5 to 98%, and the contact resistance between the conductive frit film 8 and the conductive spacer 7 is substantially zero ohm.

Even in the structure such as this, the conductive frit film 8 is securely fixed to the inner wall surface of the neck tube 1*c* and the end of the conductive film 4, so that the contact resistance of the conductive spacer 7 is improved and the effects similar to those mentioned above are obtained. Moreover, becaue of absence of the intermediate graphite layer, the adhesion of the conductive frit glass film to the neck tube is enhanced.

As has been explained heretofore, the present invention provides a conductive frit film on the inner wall surface of the neck tube which contacts the conductive spacer of the electron gun, thereby radically improving the resistance against the scratching-off which is caused by rubbing of the conductive spacer and eliminating generation of dusts. This at the same time securely prevents spark generations between the contacting portions, completely removes the chances of inferior contacts caused by spattering of the contacting portions and drastically improves the quality and the reliability of the color picture tubes. The present invention is thus extremely effective.

What is claimed is:

1. In a color picture tube comprising a vacuum envelope constituted by a panel portion, a funnel portion and a neck tube, an electron gun structure housed in the neck tube, an electrically conductive film coated on the inner wall surface of the envelope and extending from the funnel portion to the neck tube, and an electrically conductive spacer having one end secured to the electron gun structure and the other end in contact with the conductive film, the improvement wherein a portion of the conductive film which makes contact with the conductive spacer comprises an electrically conductive frit film made of a mixture of an electrically conductive material and frit glass.

2. A color picture tube according to claim 1 wherein the portion of the conductive film is of a double layer structure of the conductive film and the conductive frit film.

3. A color picture tube according to claim 1 wherein the portion of the conductive film comprises a single layer structure of the conductive frit film directly coated on the inner wall surface of the envelope, and one end portion of the single layer structure overlapping the end of the conductive film.

4. A color picture tube according to claim 1 wherein the portion of the conductive film overlies on the inner wall surface of the neck tube.

5. A color picture tube according to claim 1 wherein the portion of the conductive film further comprises a water soluble substance used for a binder of the frit glass and the conductive material.

6. A color picture tube according to claim 1 wherein the conductive material is silver.

7. A color picture tube according to claim 1 wherein the conductive material mainly contains silver.

8. A color picture tube according to claim 1 wherein the ratio of the conductive material to be mixed with the frit glass is set within the range of 5 to 95% by weight.

9. A color picture tube according to claim 1 wherein the thickness of the conductive frit film after sintering is set within the range of 0.05 to 500 $\mu$m.

* * * * *